United States Patent [19]

Sakai et al.

[11] Patent Number: 4,517,794

[45] Date of Patent: May 21, 1985

[54] METHOD OF GUIDING YARN END IN AIR SPINNING APPARATUS

[75] Inventors: Shoji Sakai, Kyoto; Michiaki Fujiwara, Shinomachi; Nobunori Kubota; Koshi Noda, both of Kyoto, all of Japan

[73] Assignee: Murata Kikai Kabushiki Kaisha, Kyoto, Japan

[21] Appl. No.: 335,222

[22] Filed: Dec. 28, 1981

[30] Foreign Application Priority Data

Oct. 22, 1981 [JP] Japan ..... 56-169527

[51] Int. Cl.[3] ..... D01H 11/00; D02G 1/16

[52] U.S. Cl. ..... 57/304; 57/261; 57/300

[58] Field of Search ..... 57/300, 301, 303, 304, 57/306, 22, 261, 908, 328

[56] References Cited

U.S. PATENT DOCUMENTS 3,992,865 11/1976 Tuchida et al. ..... 57/328
4,107,911 8/1978 Yamana et al. ..... 57/304
4,169,350 10/1979 Yamana et al. ..... 57/261 X

*Primary Examiner*—Donald Watkins
*Attorney, Agent, or Firm*—Spensley, Horn, Jubas & Lubitz

[57] ABSTRACT

A device for the uniform retrieval of yarn ends in an air spinning device. A suction force gradient is created between the air jet nozzle and the waste suction pipe. Gravitational force and the suction gradient cause broken yarn ends to drop from the air jet nozzle orifice toward the waste suction pipe. When yarn piecing is desired, a piecing suction pipe retrieves the yarn end from the nozzle orifice.

14 Claims, 3 Drawing Figures

METHOD OF GUIDING YARN END IN AIR SPINNING APPARATUS

BACKGROUND OF THE INVENTION

1. Field of the Invention

This invention relates to a method of guiding the yarn end in the air spinning apparatus which spins the yarn by means of a drafting part and an air jet nozzle arranged in a position subsequent to said drafting part.

2. Description of the Prior Art

In a spinning apparatus in which the drafted sliver is guided into an air jet nozzle unit for spinning, and the yarn thus spun is wound into a package form, a device for piecing yarn ends is usually attached to said spinning apparatus. Said piecing device operates, when the yarn is broken, for piecing together yarn ends from both the air jet nozzle unit side and the package side after introducing said yarn ends to said piecing device by means of a piecing suction pipe.

Usually, there is provided a dust box near the jetting orifice of the air jet nozzle which utilizes a waste suction pipe in order to catch fly waste and dust emitted from said air jet nozzle.

When the piecing suction pipe is adapted to operate at a place near the air jet nozzle orifice when the yarn is cut or broken, the end of the spun yarn emitted from the air jet nozzle is often sucked into the depth of said dust box. Mistakes in suction of the yarn end by the piecing suction pipe have hitherto frequently been made in such a way.

An objective of the present invention is to provide a method of guiding the yarn end emerging from the air jet nozzle so as to reduce mistakes in suction of the yarn end by the piecing suction pipe when piecing yarn ends as described above.

SUMMARY OF THE INVENTION

In accordance with the present invention, these and other objectives are achieved by providing a dust box and a waste suction pipe adapted so that a broken or cut yarn end will drop from the air jet nozzle orifice and be drawn into the waste suction pipe. Alternatively, when yarn piecing is desired, the yarn end is sucked into the suction pipe of the yarn piecing device rather than into the dust box or waste suction pipe.

DESCRIPTION OF THE PREFERRED EMBODIMENT

The following detailed description is of the best presently contemplated mode of carrying out the invention. This description is not to be taken in a limiting sense, it is made merely for the purpose of illustrating the general principles of the invention since the scope of the invention is best defined by the appended claims.

Figure 1:
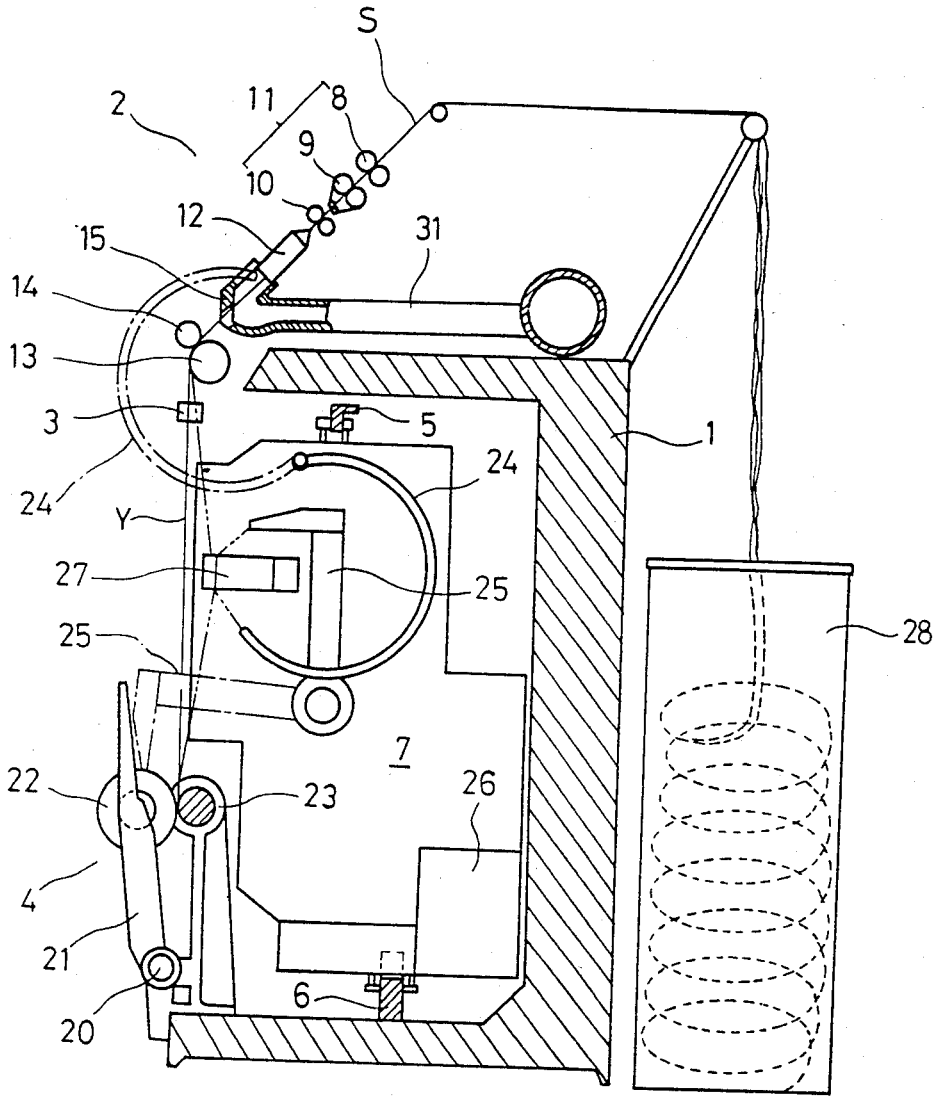
FIG. 1 is a schematic view of the whole of an air spinning apparatus according to the present invention.
Figure 2:
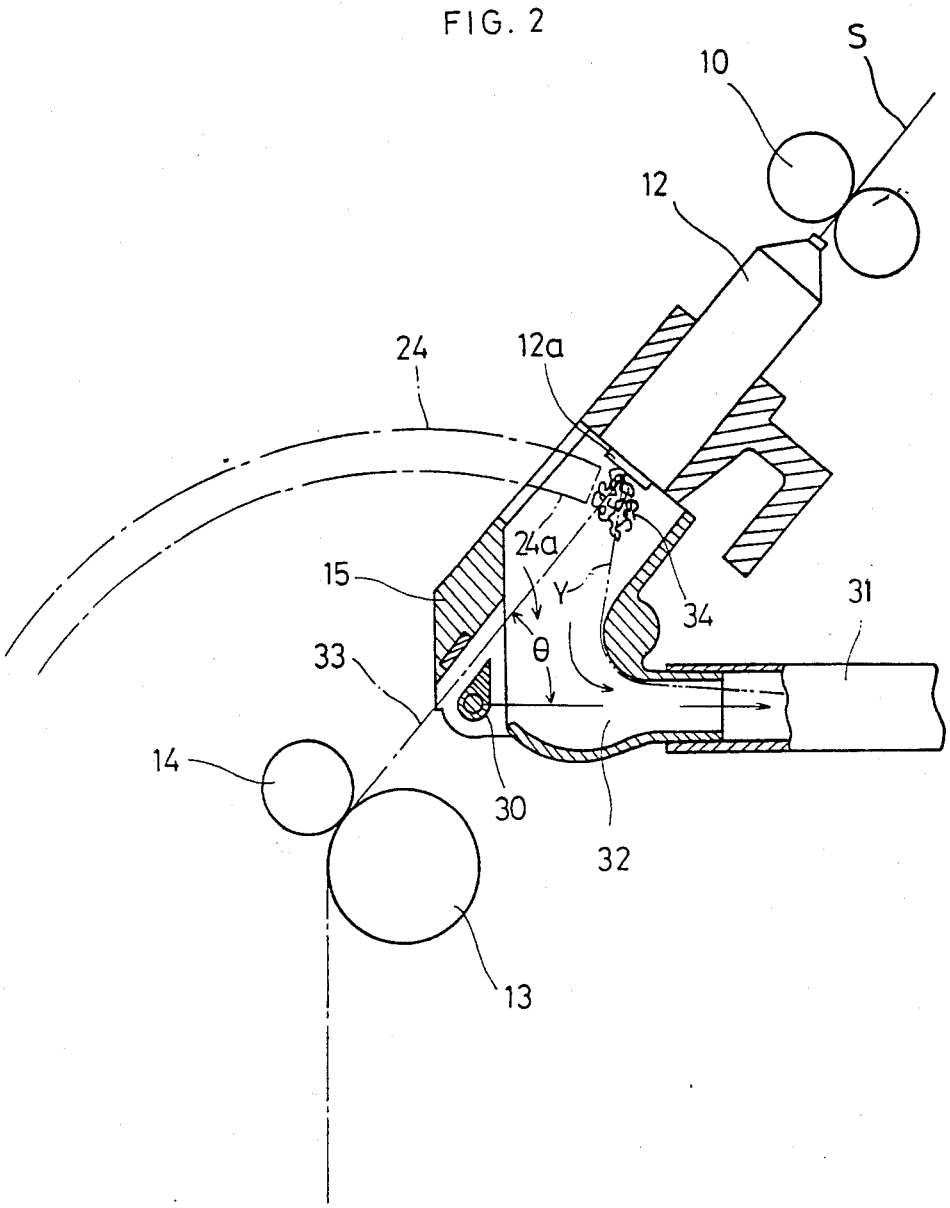
FIG. 2 is an enlarged sectional view of the air jet nozzle and dust box of FIG. 1.
Figure 3:
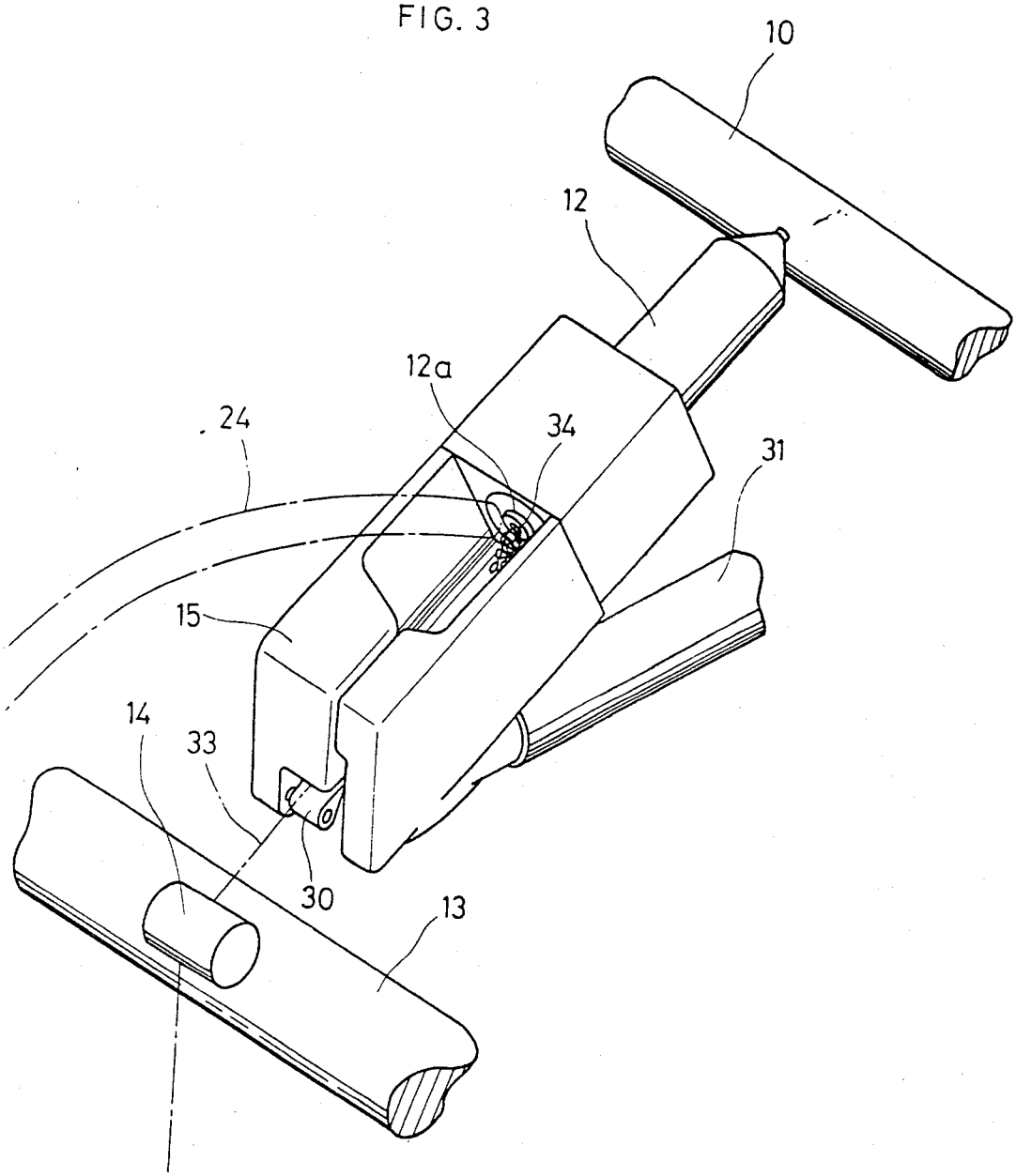
FIG. 3 is a perspective view of the components of the unit of FIG. 2.

Referring to FIGS. 1 and 2 the reference numeral 1 designates a frame of the spinning apparatus according to this invention provided with air spinning unit 2 on top, a slub catcher 3 and winding part 4 in front, and a yarn piecing device 7 internally disposed and capable of moving on guide rails 5 and 6 along the length (normal to the plane of FIG. 1) of the frame 1.

The air spinning unit 2 comprises a drafting part 11 consisting of pairs of back rollers 8, aprons 9, and front rollers 10; an air jet nozzle 12 subsequent to said drafting part; a delivery roller 13; a nip roller 14; and a dust box 15 attached to said air jet nozzle 12. The air jet nozzle provides a hole, extending longitudinally through its length, through which sliver S enters and spun yarn exits, said exit being known as the air jet nozzle orifice 12*a*.

The winding part 4 is composed so as to bring the package 22 into contact with the friction roller 23 by means of the cradle 21 rotatably supported by the shaft 20.

The yarn piecing device 7 is provided with a piecing suction pipe 24 for sucking the yarn end from the air jet nozzle orifice 12*a*, and another suction pipe 25 for sucking the yarn end on the package side or the winding part side, a blower 26 for generating air current in each of the above described suction pipes 24 and 25, and a knotter 27. Said suction pipes 24 and 25 are turnable in a vertical plane.

The sliver S drawn out from the can 28 is spun by said air spinning unit 2 through the delivery roller 13 and the nip roller 14 and wound up into a package form 22. When a slub is detected by the slub catcher 3, a cutter 30 provided in the dust box 15 is operated to cut the yarn Y.

The action of the cutter 30 in rotating to cut the yarn Y also serves to partially block an air flow path out of the dust box 15 through its yarn exit. This in turn serves to somewhat increase the force with which the waste suction pipe 31 acts upon material within dust box 15.

In practice, when the spun yarn has been cut, it tends to become twisted and entangled into a small mass suspended from the air jet nozzle orifice 12*a* as shown in FIG. 2. The weight of the entangled yarn end 34, together with the suction air flow exerted by the waste suction pipe 31, causes the yarn end 34 to drop to the bottom of connecting part 32, pulling with it the yarn remaining in air jet nozzle 12. The free yarn end 34 which falls to the bottom of connecting part 32 is sucked into waste suction pipe 31. When the yarn end 34 has been sucked into the waste suction pipe 31, the air spinning unit 2 is stopped and further spinning is suspended, so that no material is left behind in the dust box 15. The yarn end remaining on the winding part side is fed toward the package by the delivery roller 13 and the nip roller 14.

In this embodiment, the structure interposed between the air jet nozzle orifice 12*a* and the delivery roller 13 and nip roller 14 pair and between said orifice 12*a* and the waste suction pipe 31, comprising the dust box 15 its associated cutter 30, and connecting part 32, is constructed such that the yarn end 34 is not directly sucked into the waste suction pipe 31 but remains twisted and entangled into a small mass. That is to say, in this dust box 15, the part connecting part 32, which connects the waste suction pipe 31 to the dust box 15 is located remotely from the nozzle orifice 12*a*, particularly, at or near the bottom of the dust box 15. Moreover, an angle $\theta$, formed by the connecting part 32 in connecting said waste suction pipe 31 with the dust box 15, is configured such that the intersection of a line extending along the running path 33 of the yarn through the dust box 15 toward the nozzle orifice 12*a* and a line extending along the waste suction pipe 31 toward the source of the suction, creates an acute angle. In the preferred embodiment of the invention the angle $\theta$ is 45°, although the angle $\theta$ may range from 20° to 80° in other embodiments of the invention.

When yarn piecing is intended as the next step, the air spinning unit 2 is operated again for spinning of yarn anew from the air jet nozzle 12. The piecing suction pipe 24 is turned vertically upward to a position denoted by the alternate long and short dashed line in FIGS. 1 and 2 for sucking the yarn end through the suction mouth 24*a*.

Since, after the cutter 30 has resumed its non-cutting position, the air current created by the waste suction pipe 31 is sharply turned at said connecting part 32 and, in addition, said part 32 is located some distance from the air jet nozzle orifice 12*a*, and further that portions of the dust box 15 in the vicinity of the cutter 30 are open to the exterior air, the suction air flow from waste suction pipe 31 is reduced, in a zone near the nozzle orifice 12*a* from that in the waste suction pipe 31. The entangled yarn end 34 emerging from the air jet nozzle orifice 12*a* is therefore not sucked into the waste suction pipe 31 but remains in the zone near the nozzle orifice 12*a*.

As a result, by adapting the suction mouth 24*a* of said piecing suction pipe 24 to approach the nozzle orifice 12*a* when said piecing suction pipe 24 is turned to a position indicated by the alternate long and short dashed lines in FIG. 2, the piecing suction pipe 24 will always be able to entrap said entangled yarn end, and, by downward rotation to the position indicated by the solid lines of FIG. 1, draw said yarn end to the knotter 27. Similarly, the loose yarn end at the package 22 is entrapped by the other suction pipe 25, at its downward position indicated by the alternate long and short dashed lines in FIG. 1. Upward rotation of said other suction pipe 25 to the solid line position in FIG. 1 draws this end of yarn to the knotter 27.

The above embodiment has the advantage that air sucking pressure in the waste suction pipe 31 connected to the dust box 15 need not be varied during the piercing operation and may remain capable of sucking debris all the time.

In another embodiment, the purpose may be fulfilled by an arrangement in which the dust box 15 is an ordinary structure but sucking pressure in the suction pipe 31 is adapted to act synchronously with the operation of said air spinning unit 2. At the time of re-starting of spinning after said spinning unit 2 is stopped, said pressure in the suction pipe 31 would be temporarily reduced for weakening the sucking air current in the dust box 15 so as to stay the yarn end 34 spun from the air jet nozzle 12 near the nozzle orifice 12*a*.

According to this invention, sure capture of the yarn by the piercing suction pipe 24 is attained even under low suction pressure, whereby mistakes in yarn end suction are eliminated.

What is claimed is:

1. In a spinning apparatus using an air jet nozzle having a nozzle orifice from which spun yarn exits said jet nozzle, a device for uniformly retrieving a loose yarn end located at said nozzle orifice comprising:

suction means disposed remotely from said nozzle orifice for removing debris;

connection means for connecting said suction means solely to said nozzle orifice, such that said suction means will remove dust from said nozzle orifice by a continuous suction air flow through said suction means; and retrieval means, relocatably positionable between a position remote from said nozzle orifice and a position within said connection means adjacent said nozzle orifice, for retrieving and retaining said loose yarn end at said nozzle orifice in the presence of said continuous suction air flow, such that said retrieval means will uniformly dominate the tendency of said loose yarn end to be drawn into said suction means.

2. In a spinning apparatus using an air jet nozzle having a nozzle orifice from which spun yarn exits said jet nozzle, a device for uniformly retrieving a loose yarn end located at said nozzle orifice, comprising:

suction means disposed remotely from said nozzle orifice for removing debris;

connection means for connecting said suction means solely to said nozzle orifice, such that said suction means will remove dust from said nozzle orifice by a continuous suction air flow through said suction means; and a second suction pipe rotatably mounted so as to retrieve said loose yarn end from said nozzle orifice, in the presence of continuous suction through said connection means, and deliver said loose yarn end to another location.

3. A device as claimed in claim 2, wherein said connection means further comprises a tube whose length is such that the continuous suction generated by said suction means, after traversing said connection means to the region of said nozzle orifice, is sufficient to remove said debris friom said nozzle orifice but is degraded by said traversal so that said suction is insufficient to remove said yarn end from said nozzle orifice in the presence of suction through said second suction pipe.

4. A device as in claims 2 or 3 wherein said connection means forms an acute angle between said suction means and a line directed toward and through said nozzle orifice.

5. A jet spinning device for producing spun yarn comprising:

fluid jet means for spinning said yarn, said fluid jet means having an orifice from which said yarn emerges;

suction means for removing debris from said orifice of said fluid jet means, said suction means being located generally below said orifice of said fluid jet means, whereby said debris will tend to fall under gravity from said orifice of said fluid jet means to said suction means, thereby aiding removal of said debris; and means for continuously creating a suction force gradient between said orifice of said fluid jet means and said suction means, said suction force gradient being directed between said orifice of said fluid jet means substantially downwardly to said suction means so as to be strongest at said suction means and weakest at said orifice of said fluid jet means.

6. A jet spinning device for producing spun yarn comprising:

fluid jet means for spinning said yarn, said fluid jet means having an orifice from which said yarn emerges;

suction means for removing debris from said orifice of said fluid jet means, said suction means being located generally below said orifice of said fluid jet means, whereby said debris will tend to fall under gravity from said orifice of said fluid jet means to said suction means, thereby aiding removal of said debris; and connecting means for connecting said orifice of said fluid jet means to said suction means such that a suction force gradient is continuously created within said connecting means between said fluid jet means and said suction means, said suction force gradient being directed between said orifice of said fluid jet means substantially downwardly to said suction means so as to be strongest at said suction means and weakest at said orifice of said fluid jet means.

7. A device as in claim 6 wherein said connection means forms an acute angle between the reverse of the yarn running path through said fluid jet means and the air flow through said suction means.

8. A jet spinning device for producing spun yarn comprising:

fluid jet means for spinning said yarn, said fluid jet means having an orifice from which said yarn emerges;

suction means for removing debris from said orifice of said fluid jet means, said suction means being located generally below said orifice of said fluid jet means, whereby said debris will tend to fall under gravity from said orifice of said fluid jet means toward said suction means, thereby aiding removal of said debris;

means for continuously creating a suction force gradient between said orifice of said fluid jet means and said suction means, said suction force gradient being directed between said orifice of said fluid jet means substantially downwardly to said suction means so as to be strongest at said suction means and weakest at said orifice of said fluid jet means; and retrieval means, rotatably disposed adjacent said orifice of said fluid jet means within said means for continuously creating a suction force gradient, for retrieving and retaining a loose yarn end, broken during spinning operations, from said orifice of said fluid jet means, and for delivering said loose yarn end to another location.

9. In a jet spinning device for producing spun yarn comprising:

fluid jet means for spinning said yarn, said fluid jet means having an orifice from which said spun yarn emerges;

and suction means for removing debris from said orifice of said fluid jet means, by a substantially downwardly directed continuous suction air flow;

the improvement consisting of:

connecting means for separating said suction means from said orifice of said fluid jet means, said connecting means providing a space within which said continuous suction air flow exhibits a gradient, reducing from said suction means toward said orifice of said fluid jet means.

10. The improvement claimed in claim 9 further comprising:

retrieval means for retrieving and retaining, from said orifice of said fluid jet means, a loose yarn end resulting from a yarn breakage occurring during jet spinning operation of said device, and for delivering said loose yarn end from said orifice of said fluid jet means to another location.

11. The improvement in claim 10, wherein said retrieval means is rotatably disposed adjacent said orifice of said fluid jet means within said connecting means whereat said reduced suction air flow resides.

12. In a jet spinning device for producing spun yarn comprising:

fluid jet means for spinning said yarn, said fluid jet means having an orifice from which said yarn emerges; and suction means for removing debris from said orifice of said fluid jet means, by a substantially downwardly directed continuous suction air flow;

the improvement comprising:

connecting means for separating said suction means from said orifice of said fluid jet means, said connecting means providing a space within which said continuous suction air flow exhibits a gradient, reducing from said suction means toward said orifice of said fluid jet means; and second suction means for capturing and retrieving a loose yarn end resulting from a yarn breakage occurring during jet spinning operation of said jet spinning device, said second suction means being rotatably disposed adjacent said orifice of said fluid jet means within said connecting means whereat said reduced suction air flow resides, said second suction means being capable of delivering said loose yarn end from said orifice of said fluid jet means to another location.

13. In a jet spinning device for producing spun yarn comprising:

fluid jet means for spinning said yarn;

suction means for continuously removing debris from the vicinity of said fluid jet means; and knotting means for splicing together broken ends of said yarn;

the improvement consisting of:

retrieval means for returning a loose yarn end, broken during spinning operations, from said fluid jet means, and for delivering said loose yarn end to said knotting means;

wherein said retrieval means is rotatably positioned adjacent said fluid jet means whereat, despite the presence of continuous suction from said suction means, said loose yarn end is captured by said retrieval means and whereafter said retrieval means, retaining said loose yard end, is rotated to a position adjacent said knotting means, thereby delivering said loose yarn end thereto.

14. In an air jet spinning device for producing spun yarn having;

an air jet nozzle orifice from which spun yarn emanates;

suction means for continuously removing debris from the vicinity of said air jet nozzle orifice; and knotting means for piecing together two broken yarn ends, one which emanates from said air jet nozzle orifice and the other of which is delivered to and present at said knotting means;

the improvement comprising:

a piecing-up suction pipe formed of a rigid, hollow tubular material having:

a length curved into a generally semi-circular configuration;

a suction mouth at one end of said length; and the other end of said length sealably and rotatably affixed to a second suction means for providing a suction air flow therethrough;

said piecing-up suction pipe being disposed in a first position wherein said suction mouth is in proximity to said knotting means; and means, operative when a break is detected in the spun yarn emanating from said air jet nozzle orifice, for rotating said piecing-up suction pipe about its end affixed to said second suction means to a second position wherein said suction mouth is in close proximity to said air jet nozzle orifice whereat said broken yarn end emanating from said jet nozzle orifice is drawn to said suction mouth by said suction air flow, and thereafter for rotating said piecing-up suction pipe, with the retained yarn end, back to its first position whereat said yarn end is delivered to said knotting means.

* * * * *